United States Patent [19]

Wadsworth, Jr.

[11] 3,938,374

[45] Feb. 17, 1976

[54] TOOL FOR FORMING INTERNAL THREADS

[75] Inventor: Gilbert A. Wadsworth, Jr., Cockeysville, Md.

[73] Assignee: Dynatherm Corporation, Cockeysville, Md.

[22] Filed: Feb. 6, 1975

[21] Appl. No.: 547,487

[52] U.S. Cl. ..... 72/104; 72/120

[51] Int. Cl.[2] ..... B21H 3/08

[58] Field of Search ..... 72/104, 120, 122, 123

[56] References Cited

UNITED STATES PATENTS

| | | | |
|---|---|---|---|
| 1,717,720 | 6/1929 | Martin et al. | 72/122 |
| 1,798,742 | 3/1931 | Kellogg | 72/122 |
| 3,587,272 | 6/1971 | Zmuda | 72/122 |
| 3,681,802 | 8/1972 | Youtz et al. | 72/104 |

*Primary Examiner*—Lowell A. Larson
*Attorney, Agent, or Firm*—A. H. Caser

[57] ABSTRACT

The invention provides a tool for forming threads or grooves on the internal surface of a pipe.

7 Claims, 12 Drawing Figures

TOOL FOR FORMING INTERNAL THREADS

BACKGROUND OF THE INVENTION.

1. The field of the invention comprises thread-forming tools.

2. So far as is known, the invention is new, although the principle of forming threads, as used herein, is old. Thread forming or thread rolling is basically a cold forging process in which a thread is formed by displacement of material. The advantages of the process are well known, such as accuracy as required for precision threads, uniformity, smoothness, material economy in that the blank size is closer to the finished product size, thread strength, high production rate, and, of special importance, the absence of cuttings or chips which otherwise would be difficult to remove. The process is generally limited to external threading, using a pair of flat-faced reciprocating dies to form threads on, say, a bolt blank disposed between the dies, or using a pair of cylindrical dies. In a few applications an external thread on a thin-walled tube is rolled with a matching mandrel to form an internal thread as well. In one recently patented system, a copper tube is described as being internally threaded by means of a rotating shaft disposed inside the tube, the shaft having a tool holder mounted in its end which carries a fixedly secured cutter in the form of a short solid rod having a bevelled end whose edges do the cutting. As the shaft rotates, so does the cutter, and the tube is moved linearly past the cutter so that a groove may be cut in the inner surface of the tube. As will be described, the invention is unlike the foregoing system in not using a fixed, non-rotating, shaft-mounted cutter, but rather using housing-mounted rotatable thread-forming means that is radially movable toward and from the internal pipe surface that is to be threaded, and in having means for controlling such radial movement of the thread-forming means. A significant advantage may thus be apparent, for by moving the thread former radially away from the said surface, the tool can be inserted into the pipe to any point along its internal length, and any part of such length can be threaded by moving the thread former radially into operative contact with the said surface. Such selective internal threading cannot be done with the described patented system or with any other process known to applicant. Other advantages will be apparent as the description proceeds.

SUMMARY OF THE INVENTION.

The thread-forming or threadrolling tool comprises a housing having a bore extending therethrough from a forming end portion to a supporting end portion. The housing essentially comprises at least one, and preferably a plurality of, flexible segments having a free or radially movable end portion at the said forming end portion. Rotatable thread-forming means is mounted for rotation in the radially movable end portion of each segment.. Means are present in the bore of the housing operative to force the segment end portion radially outwardly so that the thread forming means may operatively engage the internal surface of a pipe positioned radially outwardly thereof, thereby to enable a thread to be formed continuously in the pipe. Means extending from the bore through the said supporting end portion of the housing are used to actuate the said forcing means to render the latter operative, and such actuating means are also used to release the forcing means to render the latter inoperative.

BRIEF DESCRIPTION OF THE DRAWINGS.

The invention may be better understood by referring to the accompanying drawings, in which.

Figure 4:
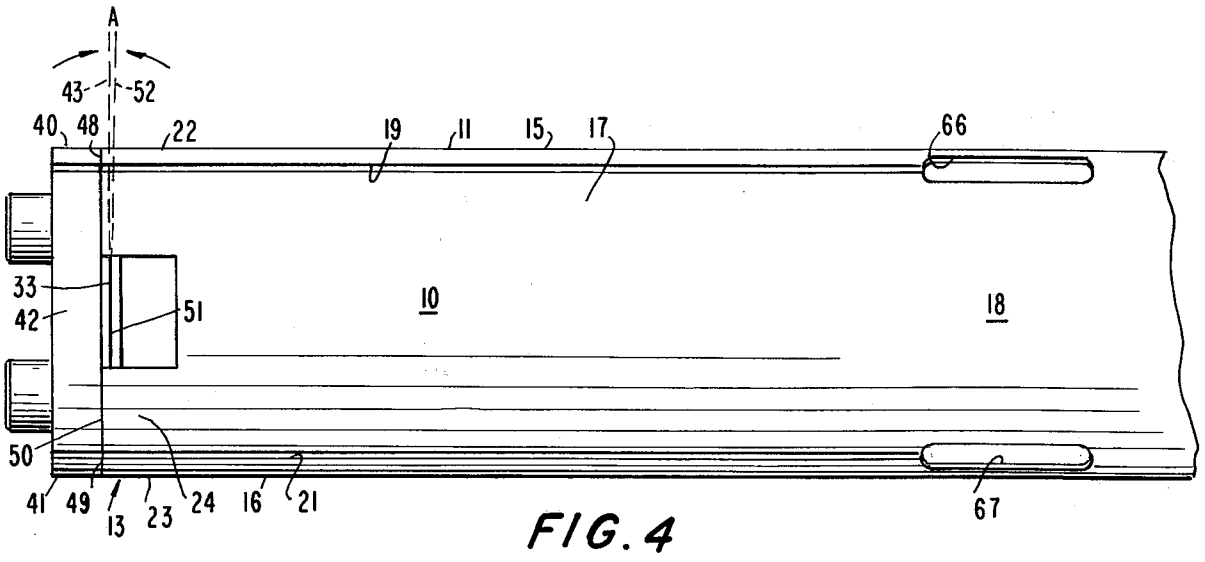
FIG. 4 is a view of FIG. 1 looking along the arrow X.
Figure 1:
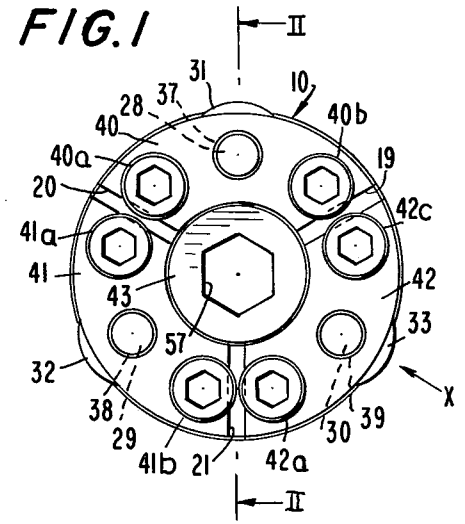
FIG. 1 is an end view of the tool, i.e., the forming end.

DESCRIPTION OF SPECIFIC EMBODIMENTS.

Referring to FIGS. 1–4, the tool 10 is shown as comprising a tubular member or housing 11 having a bore 12 extending longitudinally through it from a forming end portion at 13 to a supporting end portion at 14. Member or housing 11 comprises at least one flexible segment, but preferably a plurality, in this case three, as shown at 15, 16, and 17. These are circumferentially spaced and extend longitudinally of the member from an intermediate portion, generally indicated at 18, to the forming end portion 13, and are formed by the relatively narrow slots 19, 20, and 21 which are coextensive in length with the segments and which extend through the wall thickness of member 11, note FIG. 3. Each segment has what may be termed a free end or free end portion 22, 23, and 24 at the forming end of the tool but which more properly is termed a radially movable end portion since, owing to the flexibility of the segment, it may be moved outwardly and inwardly in a radial direction, as will be described.

At its free or radially movabe end portion each segment has a recess 25, 26, and 27 (only 25 is visible, note FIG. 2) in its end face or edge 48, 49, and 50 which receives a shaft 28, 29, and 30 having rotatable thread-forming means in the form of wheels 31, 32, and 33 mounted for free rotation thereon. The inner end of each shaft is press-fitted in its recess so that it is secured in place while the outer end is received in recesses 37, 38, and 39 of arcuate end segments 40, 41, and 42 which are removably secured to the end faces or edges of the longitudinal segments by a pair of fasteners, suitably by threaded bolts having heads that are recessed to receive an Allen wrench. These fasteners are designated as 40*a* and 40*b*, 41*a* and 41*b*, and 42*a* and 42*b*. The arcuate segments are removable for any reason, as to permit replacement of the forming wheels.

By using three forming wheels the tool can produce three internal threads simultaneously in a given pipe. The wheels may or may not be angularly disposed relatively to a plane passing through the edges or end faces 48, 49, and 50 of the longitudinal segments, note FIG.

4. If an angular disposition is used, the angle may have any suitable value; that shown at A in FIG. 4 is 0° 57′ 50″, which is merely illustrative; in this view the broken line 43 represents a plane passing through the forming edge 51 of the wheel 33, and the broken line 52 represents a plane parallel to said end faces 48, 49, and 50. Generally, the angle may vary from 0° to N°, where N is the normal helix angle of the desired thread. As is apparent, use of an angular disposition of the wheels is optional; where it is present, it may help to maintain perpendicularity between the wheels and the threads being formed.

The tool is provided with means in the bore 12–12*a* operative to force the end portions of the segments 15–17 radially outwardly so that the thread-forming wheels may operatively engage the internal surface of a pipe positioned radially outwardly of the wheels; and to control such forcing means, a further means is provided to actuate the forcing means to render the same operative and to release or inactuate the same to make said forcing means inoperative.

Figure 2:
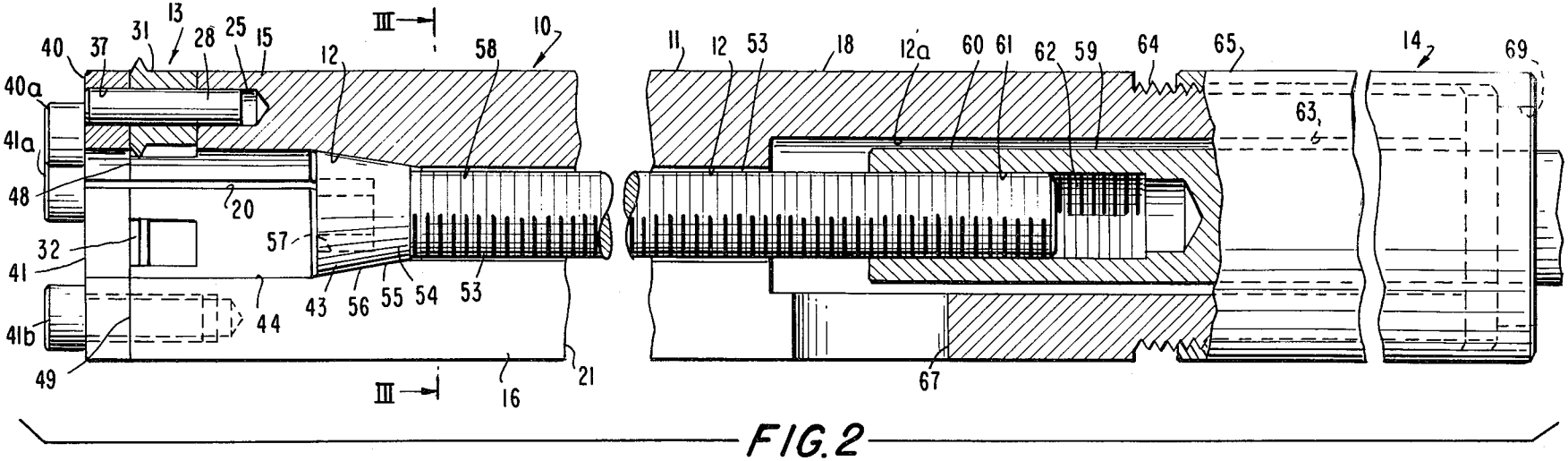
FIG. 2 is a broken, partly sectioned view along the line II—II of FIG. 1.

The segment forcing means comprise a movable member in the bore, preferably a member that is threaded, as at 53, plus a cam portion 54 on the member, plus a corresponding cam portion 55 on walls 56 of the bore adjacent the cam portion 54. Cam portion 55 comprises the bevelled walls defining the bore at the location in question; actually, these bevelled walls are longer than shown; they are more correctly represented in FIGS. 5 and 6. When member 53 is engaged (by means described below) and drawn to the right, as seen in FIG. 2, the interengaging cam portions 54 and 55 act to force the segment free ends radially outwardly so that the wheels 31-33 may operatively engage the internal surface of a pipe. The radial displacement of these free ends is not shown in FIG. 2 but may be seen in FIGS. 6 and 6*a*. It will be apparent that the threaded member 53 is a bolt having a tapered head 43 that is recessed at 57 to receive an Allen wrench, although any suitable wrench engagement may be used. Member 53 does not threadedly engage the bore at 58, being freely movable therethrough.

The actuating means for controlling the forcing means, i.e., for rendering from operative and for releasing them to make the same inoperative, comprise, in a preferred form, an actuator rod 59 having an inner end portion 60 that is recessed at 61 to receive the member 53. The recess 61 is preferably threaded at 62, so that the engagement between member 53 and rod 59 is a threaded one, and the rod is thus able to control linear movement of the member. Rod 59 enters a recess 63 (which corresponds to 12*a*) in housing 11 from the supporting end portion 14 of the latter, and it is movable through such recess in a manner to be described. Note that bore 12 is enlarged, as at 12*a*, to receive the rod, and also at 44 to receive the member 53.

Tubular member or housing 11 has external threads 64 on its supporting end portion which are engageable by an open-ended sleeve 65 which is useful to vary the effective length of the tool, as desired. At the inner end of the slots 19, 20, 21, and interconnected therewith, are recesses 66, 67, and 68 of larger width than the slots, the purpose of which is to avoid stress concentrations that may lead to cracking of the flexible segments.

Figures 3, 5, 5A, 5B, 6, 6A:
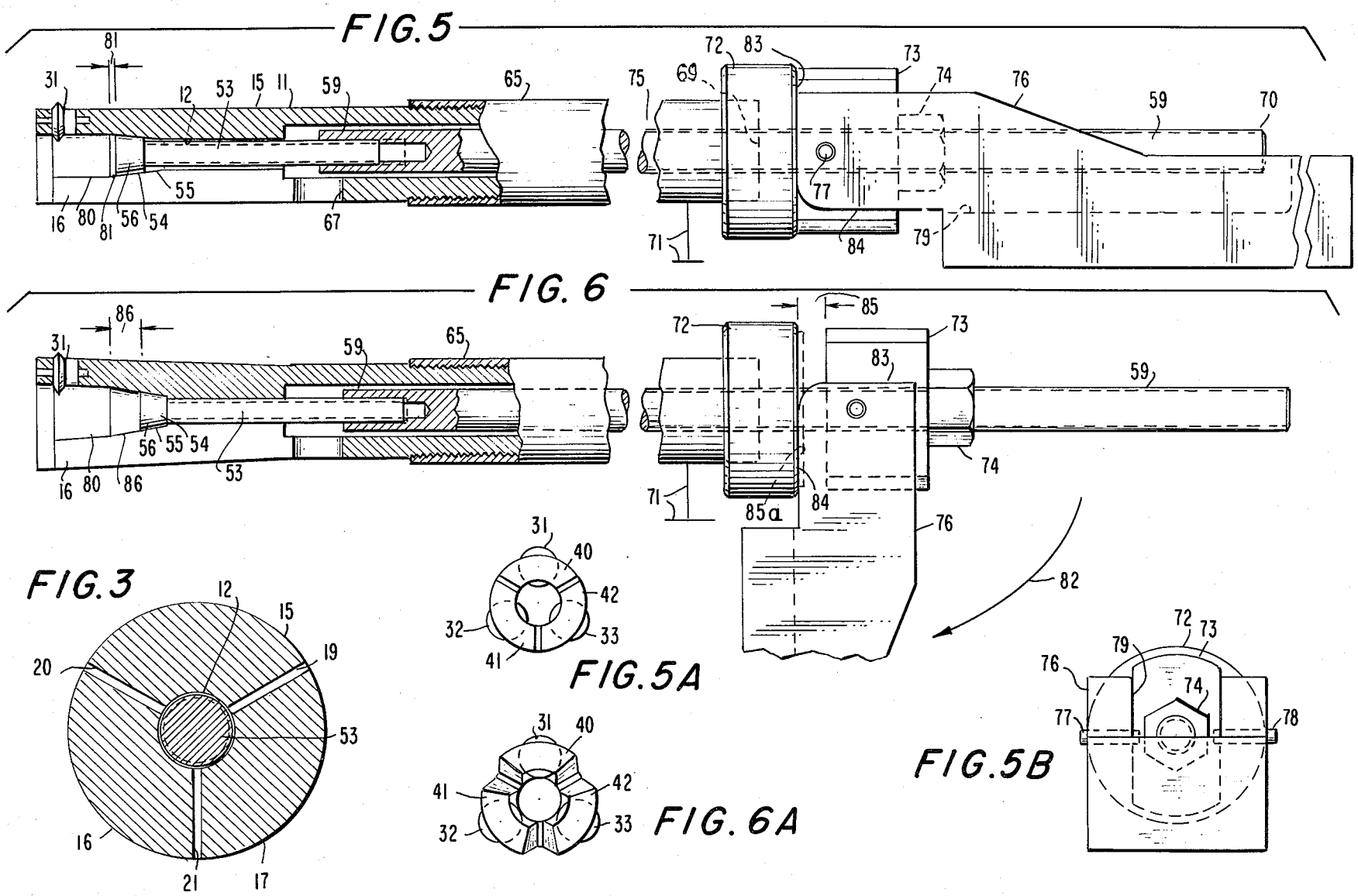
FIG. 3 is a cross section along line III—III of FIG. 2.
FIG. 5 is a partially sectioned, broken, diagrammatic view showing how the tool may be used in association with a conventional lathe.
FIG. 6 is a view like FIG. 5.
FIGS. 5*a* and 5*b* are left and right end views, respectively, of FIG. 5.
FIG. 6*a* is a left end view of FIG. 6.

FIGS. 5 and 6 show a means for operating the actuator rod 59 to force the flexible segments and forming wheels into thread-forming position, as in FIG. 6, or to release them, as in FIG. 5. As may be seen, the rod may be of substantial length, extending through an opening 69 in the end face of the sleeve 65 and extending to a point designated 70. Sleeve 65 is mounted on the tool post of a lathe (shown in FIG. 7), the post being indicated at 71, and the sleeve is threadedly engaged to a collar 72 through which the rod passes freely. Threaded on the rod in abutment with the collar is a trunnion 73 which is locked in place by nut 74. Rod 59, it may be noted, is threaded from a point approximately designated at 75 to the point 70 but is free of threads from point 75 to its outer end where it is engaged by member 53; the rod is thus freely movable in recess 12*a*–63. A movable lever 76 is pivoted to the trunnion by pins 77, 78; it is recessed at 79 to avoid collision with the rod and nut. In FIGS. 5 and 5*a*, as indicated, the forming wheels and flexible segments are in a released or relaxed position, and the cam portion 54 of member 53 is in engagement with the left hand part of corresponding cam portion 55 on the wall of bore 12. To put it another way, the bolt head 56 is spaced from the non-cam wall portion 80 of bore 12 by a narrow distance defined by arrows 81.

It will be understood that the diameter of tool 10 at the forming end portion, note FIG. 5*a*, will be small enough to pass freely into the bore of a pipe that is to be internally threaded. Such diameter is inclusive of the jutting forming wheels.

When it is desired to force the flexible segments and forming wheels into thread-forming position, which of course will be done after the forming end portion of the tool is disposed in desired position inside the pipe, the lever 76 is moved 90° downwardly, as indicated by arrow 82 in FIG. 6, to the position in the latter view. This movement results in a camming action involving moving the side or surface 83 of the lever out of contact with collar 72 and moving the side or surface 84 into such contact, with the result that rod 59 is moved to the right a small distance equal to the gap 85 between the collar and the trunnion. Or to state it another way, the bolt head 56 is now spaced from non-cam wall portion 80 by a distance 86, which can be seen to be greater than the distance 81 of FIG. 5. The cam portion 54 of bolt head 56 now engages the right hand part of corresponding cam portion 55, and the flexible segments 15-17 and forming wheels 31–33 are moved radially outwardly to a position where they can engage the surface to be threaded. This expanded position of the segments and wheels is apparent in FIG. 6 (where only one wheel is shown) and also in FIG. 6*a*.

Lever 76, as may be seen, comprises a two-position cam lever. Spring tension provided by the tool collet end of the lathe helps to secure the lever in either position.

It will be understood that the expanded diameter of the tool 10 at the forming end portion, note FIGS. 6 and 6*a*, will be sufficiently large to enable the wheels 31–33 to form threads in the internal surface of a desired pipe size.

Figure 7:
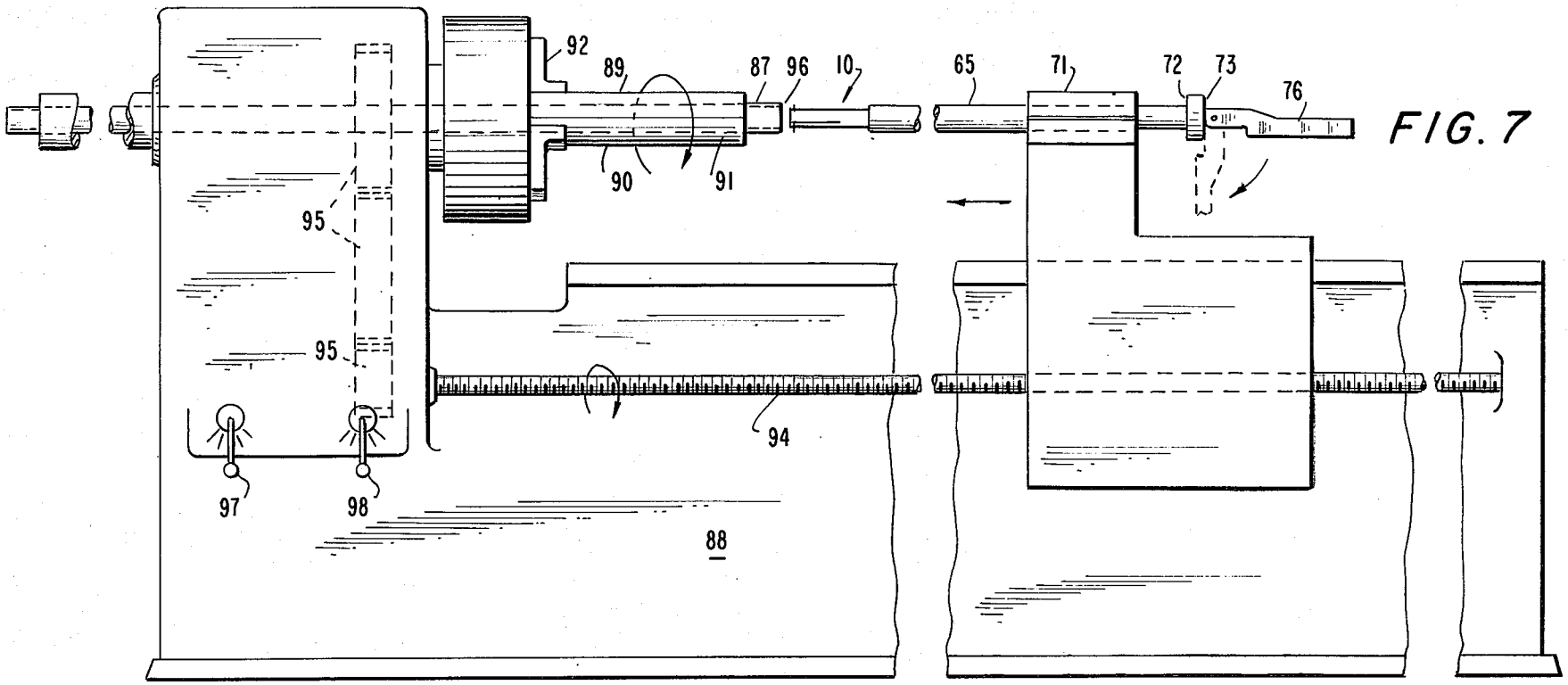
FIG. 7 is a broken, diagrammatic view, similar to FIG. 5, but showing more of the lathe and the disposition of the tool relatively to a pipe to be threaded.

FIG. 7 shows in a schematic way how the tool 10 may be employed to internally thread a pipe 87 using a lathe 88 to support the two. The pipe may be supported between two longitudinal halves 89, 90 of a heavy-walled tube fixture 91, especially where the pipe has relatively thin walls, but such supporting fixture may be omitted in the case of thick-walled pipes. Fixture 91, with pipe 87 in place, is clamped into the lathe chuck at 92. Tool 10, with sleeve 65 engaged thereon, is fixedly mounted on tool post 71, and it will be seen that lever 76, collar 72, and trunnion 73 are disposed to the right of the post where the lever may be grasped by an attendant. The tail stock of the lathe is not shown as it does not come into play. With lever 76 in the full line position, the lathe is started, so that pipe 87 and fixture 91 are rotated by the worm gear drive 94 through the internal gears indicated at 95, and the tool post is advanced to the left by said drive. The forming end portion of tool 10 is thus brought to the pipe inlet 96, and if threading is to start at such inlet, lever 76 to moved to the down or broken line position; if threading is to start at some position removed from inlet 96, the lever is not moved until such position is reached by the forming end portion of the tool. In either case, threading may be stopped by moving lever 76 back to the full line position to relax the segments 15–17, and the tool 10 may be easily withdrawn from the pipe after first disconnecting the tool post from the worm drive.

Shown at 97 and 98 are change gear controls for altering the lathe chuck and worm gear speeds in accordance with thread per inch requirements.

A step-by-step procedure for the operation shown in FIG. 7 may be set forth briefly as follows:

1. If the pipe to be threaded is relatively thin-walled, enclose it between the fixture tube halves and clamp the same into the lathe chuck.

2. The thread-forming tool, with attached sleeve and cam lever assembly, is clamped to the lathe tool post.

3. The lathe controls are set to the proper rotational speed of the lathe chuck and synchronous with the tool post rate of advancement to provide the desired number of threads per inch.

4. The thread-forming wheels are expanded either before or after the forming end portion of tool 10 enters the pipe. Also, at any point within the pipe, the wheels may be contracted to leave portions of the pipe unthreaded, or to withdraw the tool after completion of the threading.

5. The threaded pipe is removed from the fixture and the lathe chuck. As is apparent, the lathe mechanism is used to control the thread spacing on the pipe. This mechanism synchronizes the rotational speed of the pipe with the rate of advancement of the forming tool on the tool post to produce the desired number of threads per inch. Any standard lathe can be used.

Before the foregoing 5-step procedure is started, it may be advisable to measure the internal diameter of the pipe to be threaded since slight variations over its stated diameter may be present because of fabrication tolerances. Then the effective diameter of the wheels 31–33 may, if required, be adjusted to get the desired thread depth. Means on the tool are provided for carrying out this last step, being useful for varying the effective thread-forming diameter of the wheels as a group within limits. In one form, such means comprise the interengaging portions of member 53 and rod 59 together with the interengaging cam portions 54 and 55. Thus, it is possible to increase the effective diameter of the wheels by threading the member 53 farther into rod 59, with the result of forcing the wheels farther apart by virtue of the cam action of portion 54 on portion 55; and similarly, by unthreading member 53 to a partial extent, it is possible to decrease the effective diameter of the wheels by virtue of the relaxing action of 54 on 55. In another form, the means for varying the effective diameter of the wheels comprises the use of one or more shims in gap 85, thus changing its width. One of these optional shims is indicated at 85*a*, and it will be understood that its thickness is variable as desired. For large changes in the effective diameter of the wheels, it will be useful to construct the forming tool in appropriate sizes so that the user may select a suitable size and then make any required adjustments by using the means provided on the tool.

Figure 8:
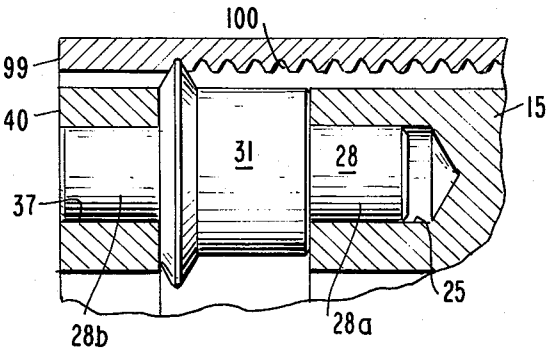
FIG. 8 is an enlarged, fragmental view of a thread-forming means and the threaded product.
Figure 9:
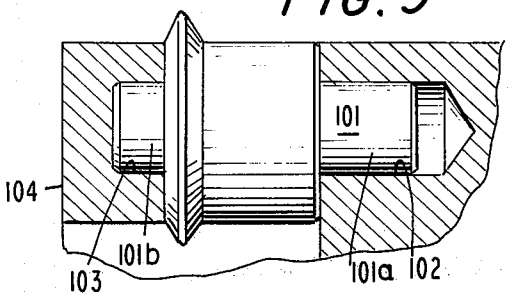
FIG. 9 is a view like FIG. 8 but omitting the product and showing a modification.

FIG. 8 illustrates a threaded product 99 as it is formed, the particular thread 100 being of modified Vee form with a rounded crest and root. Where FIG. 8 shows a shaft 28 whose inner end 28*a* is press-fitted in recess 25 and whose outer end 28*b* is non-press-fitted in recess 37, FIG. 9 shows a modification wherein both ends 101*a* and 101*b* of the shaft 101 are freely disposed in recesses 102 and 103 but in which the outer end 101*b* is received in a blind or partial recess 103 in the arcuate segment 104. In other words, in FIG. 8 the inner shaft end 28*a* is press-fitted in recess 25 while the outer shaft end 28*b* has a loose fit in recess 37, thus providing a non-rotatable shaft; and in FIG. 9 the inner and outer shaft ends are loosely fitted in their recesses so that the shaft is rotatable. In both cases the forming wheel is rotatable on the shaft. Where the shaft is intended to rotate, it can of course be supported on bearings at each end.

EXAMPLE

By way of illustration, threads were formed on the internal surface of a copper tube by means of the described tool using a lathe made by D. Mitchell & Co., Ltd., Keighley, England. Triple forming wheels in the tool each produced 20 threads per inch, or a total of 60 threads per inch, of modified acme form having a pitch of 0.05 inch. The wheels each had a diameter of 0.281 inch, each was angularly disposed at a lead angle (or camber) of 0° 57′ 50″, and each had an included angle of 60° and a maximum radius of 0.003 inch. As a group, the wheels were adjustable from a crest diameter of 0.927 inch to approximately 0.960 inch. The wheels were of tool steel hardened to a value of Rockwell C - 63.

As indicated, the forming tool in relaxed condition can enter a pipe with plenty of clearance; and when the wheels are expanded, it will be understood that they will be under sufficient pressure to form the desired threads.

Any suitable number of wheels may be present, such as one, two, three, four, or more, and these will form a like number of threads. Note that the use of three wheels, equally spaced from each other, is advantageous in that the forming forces are balanced, i.e., there is no net force on the tool which would act to make it move from one side to the other while the threads are being formed. Balanced forces may also be achieved by using 2 or 4 equally spaced wheels. Any suitable thread form can be produced, including Vee groove, acme, square, round, modifications thereof, etc., by employing forming wheels of the proper profile. A right or left helix may be produced, or a single helix, or an annular ring, or a series of spaced annular rings that are spaced from one another. In short, grooves of any type and form are possible.

The pipe metal can be any having a hardness less than that of the metal of the forming wheels; and on this topic it is relevant to note that the wheels may be made of very hard materials and may also be fabricated with tips harder than the rest of the wheels, including tips comprising embedded diamond particles or chips which would thus be able to thread pipes of metals harder than a Rockwell C-37 hardness, the latter representing an upper limit for conventional thread rolling. Pipes of more ductile metals are easily threaded, and good results have been obtained with pipes of copper and aluminum, such as 6063 aluminum and 6061 aluminum. Other useful pipe materials are wood, woodlike materials, leather, rubber, fabric, and the like, provided they are sufficiently ductile to lend themselves to the operation. Application of heat to the pipe may be useful to increase its ductility. The term "pipe" includes tubes, conduits, and any other hollow body of cylindrical or near cylindrical form.

The forming tool is of particular utility to make tubes or pipes for use as heat pipes, wherein the internal threads or grooves act as wicks or capillaries. Of importance to such utility is the ability of the invention to produce a pipe that is internally threaded only partially of its length, and at any desired location or at two or more such locations that may be spaced relatively to one another. Another particular advantage, as shown in FIG. 7, resides in the fact that the forming wheels may be expanded or relaxed by a control located outside either the tool or the pipe.

It will be appreciated that one may rotate the forming tool and linearly move the pipe relatively thereto by simply reversing the positions of these devices on the lathe.

It will be understood that the invention is capable of obvious variations without departing from its scope.

In the light of the foregoing description, the following is claimed.

I claim:

1. In a tool for forming grooves on the internal surface of a pipe comprising a housing having a bore extending from a groove-forming end portion to a supporting end portion, said housing comprising at least one flexible segment having a radially movable end portion at said forming end portion, rotatable groove-forming means mounted for rotation in said radially movable end portion of the segment, forcing means in the bore operative to force said segment end portion radially outwardly so that said groove-forming means may operatively engage the internal surface of a pipe positioned radially outwardly thereof, and actuating means extending from said bore through said supporting end portion for actuating said forcing means to render the latter operative and for releasing such forcing means to render the same inoperative.

the improvement comprising movable lever means pivotally attached to said actuating means at a point outside of and spaced from said bore for moving the actuating means, and thereby the forcing means, back and forth through a limited distance, and cam means associated with said lever means for moving and holding the actuating means, and thereby the forcing means, in operative groove-forming position and also for releasing the same from said position.

2. Tool of claim 1 wherein means are present engageable by said cam means for varying said limited distance through which said actuating and forcing means may move.

3. Tool of claim 1 wherein said forcing means comprise an elongated member extending towards said supporting end portion from a point spaced linearly inwardly of said rotatable groove-forming means, said member being radially spaced from walls defining said bore and being freely movable in the bore.

4. Tool of claim 3 wherein said actuating means is an elongated actuator rod one end portion of which extends into said housing at said supporting end portion and is engageable with said elongated member and the other end portion of which extends beyond the housing.

5. Tool of claim 4 wherein movement of said lever means to place said forcing means in operative groove-forming position creates a gap, and wherein means are present for decreasing said limited distance through which said actuating and forcing means may move comprising means insertable in the gap and engageable by said cam means for decreasing the width of the gap.

6. In a tool for forming threads on the internal surface of a pipe comprising a housing having a bore extending therethrough from a forming end portion to a supporting end portion, said housing comprising at least one flexible segment having a radially movable end at said forming end portion, a thread-forming wheel mounted for rotation in said end of each segment, an elongated threaded member disposable in said bore, an elongated threaded actuator rod in the bore threadedly engageable by said threaded member and extending through said supporting end portion to a point beyond the housing, said threaded member having a cam portion of progressively increasing diameter, a corresponding cam portion in the bore engageable by said first cam portion, and wherein said interengaging cam portions are effective to force each said segment radially outwardly so that each said wheel may operatively engage the internal surface of a pipe positioned radially outwardly of the wheel, the improvement comprising a lever pivotally attached to said actuator rod through trunnion means at a point beyond the housing and movable for moving said rod and thereby said threaded member back and forth through a limited distance, with movement in one direction acting to effectively interengage said cam portions and to force said segment and wheel radially outwardly into thread-forming position, and movement in the other direction acting to disengage said cam portions and to allow said segment and wheel to return to a normal non-thread-forming position, cam means on said lever for holding the latter, and also said rod and member, in a position where said cam portions are effectively interengaged, and other cam means on the lever for holding the latter, and also said rod and member, in a position where said cam portions are disengaged.

7. Tool of claim 6 wherein movement of said lever in a direction to interengage said cam portions creates a gap between said trunnion means and said housing, and means insertable in the gap and engageable by said cam means for decreasing the width of the gap, thereby to decrease said limited distance through which said rod and member may move.

* * * * *